US011047079B2

(12) United States Patent
Leger et al.

(10) Patent No.: US 11,047,079 B2
(45) Date of Patent: Jun. 29, 2021

(54) NEEDLE LOOM

(71) Applicant: Oskar Dilo Maschinenfabrik KG, Eberbach (DE)

(72) Inventors: Joachim Leger, Eberbach (DE); Wolfgang Schwab, Binau (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 443 days.

(21) Appl. No.: 15/993,748

(22) Filed: May 31, 2018

(65) Prior Publication Data

US 2018/0355528 A1 Dec. 13, 2018

(30) Foreign Application Priority Data

Jun. 8, 2017 (EP) ..... 17174932

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 1/46; D04H 3/105
USPC ..... 28/115
See application file for complete search history.

(56) References Cited

U.S. PATENT DOCUMENTS 5,502,879 A * 4/1996 Rinder ..... D04H 18/02 28/115
5,548,881 A * 8/1996 Ludwig ..... D04H 18/02 28/114
5,732,453 A * 3/1998 Dilo ..... D04H 18/02 28/107
8,793,848 B2 * 8/2014 Reutter ..... D04H 18/02 28/107
2006/0288549 A1 * 12/2006 Jean ..... D04H 18/02 28/107
2007/0006432 A1 * 1/2007 Noel ..... D04H 18/02 28/107

(Continued)

FOREIGN PATENT DOCUMENTS

AT 409 869 B 12/2002
FR 2 466 558 A1 4/1981

OTHER PUBLICATIONS

EP 17 17 4932 Search Report dated Oct. 16, 2017.

*Primary Examiner* — Anne M Kozak
(74) *Attorney, Agent, or Firm* — Jansson Munger; McKinley & Kirby Ltd.

(57) ABSTRACT

The needle loom for needling a nonwoven web comprises a needle beam arrangement, which comprises at least one needle beam, and a drive device for moving the needle beam arrangement back and forth in a punching direction. The drive device comprises a drive and two main shafts, on each of which a main conrod is eccentrically supported. The main conrods connect the main shafts to the needle beam arrangement in articulated fashion. The main shafts are driven rotationally in opposite directions. The drive device comprises an endless traveling transmission element, which couples the main shafts to each other. The transmission element also passes around first and second adjusting rollers. An adjusting device is provided for a translational adjustment of the position of the first and second adjusting rollers. This translational adjustment brings about a rotational adjustment of the phasing of the main shafts with respect to each other.

14 Claims, 6 Drawing Sheets

(56) References Cited

U.S. PATENT DOCUMENTS

| | | | | |
|---|---|---|---|---|
| 2009/0119894 | A1* | 5/2009 | Reutter | D04H 18/02 28/114 |
| 2010/0242240 | A1* | 9/2010 | Reutter | D04H 18/02 28/107 |
| 2010/0306978 | A1* | 12/2010 | Reutter | D04H 18/02 28/107 |
| 2011/0179611 | A1* | 7/2011 | Reutter | D04H 18/02 28/107 |

* cited by examiner

NEEDLE LOOM

CROSS REFERENCE TO RELATED APPLICATION

This application claims priority based on European Patent Application No. EP 17 174 932.8, filed Jun. 8, 2017, the contents of which are incorporated by reference in its entirety.

FIELD OF THE INVENTION

The invention relates to a needle loom for needling a nonwoven web.

BACKGROUND OF THE INVENTION

Needle looms are generally known to the skilled person and are described in, for example, Lünenschloss and Albrecht: "Vliesstoffe" [Nonwovens], Georg-Thieme-Verlag, Stuttgart, 1982, pp. 122-129.

In needle looms, a nonwoven web is usually fed to the inlet side of the needle loom and conveyed in the web-conveying direction to a needling zone. In the area of the needling zone, at least one needle beam is arranged. A needle board, which is equipped with needles for consolidating the nonwoven, is attached to the beam. In this area, the nonwoven to be needled is usually guided between a stripper plate and a punching plate. To consolidate the nonwoven, the needles are pushed in a punching direction into the nonwoven and pulled back out again at high frequency. The needles pass through openings in the stripper plate and in the punching plate. The product thus being formed is a consolidated nonwoven. The person skilled in the art is familiar with a wide variety of forms of needle looms, including double needle looms, in which needling is performed from above and from below by two needle beams, and needle looms in which the needle beam is moved along with the nonwoven web in the conveying direction of the web during the consolidation process.

So that the needles arranged on the needle beam can be punched into the nonwoven web and pulled back out again, needle looms comprise a drive device, which causes the needle beam to execute a stroke in the punching direction. Such drive devices comprise, for example, two main shafts, on each of which a main conrod is eccentrically supported, so that a rotational movement of the main shafts is converted by the main conrods into a stroking movement of the needle beam in the punching direction. The main shafts can be coupled to each other by a gear stage and preferably turn in opposite rotational directions. This makes it possible to neutralize the forces acting transversely to the punching direction which can be caused by the eccentric movement of the main conrod. Because the two main shafts are coupled by a gear stage, it is sufficient for only one of the main shafts to be driven in rotation by a drive.

Needle looms in which the needle beam is to be moved along in the conveying direction of the nonwoven web during the consolidation process usually also comprise a secondary drive or at least a horizontal guide. As a result of the superimposition of the stroking movement of the needle beam in the punching direction on the stroking movement of the needle beam in the conveying direction of the nonwoven web, the needle beam is moved around a substantially elliptical path. Needle looms of this type are known from, for example, U.S. Pat. No. 6,161,269.

It is desirable to have the ability to adapt the stroke of the needle beam in the conveying direction of the nonwoven web to the requirements in the individual case.

One possibility of making such an adjustment consists in shifting the phasing of the two main shafts. Depending on the phasing of the main shafts with respect to each other, a form of movement similar to an ellipse is obtained, which the oscillating movement of the needle beam executes. Examples of needle looms which make it possible to adjust the phasing of the main shafts with respect to each other can be found in U.S. Pat. No. 7,107,658 B2 and in U.S. Pat. No. 8,793,848 B2. The adjusting of the phasing, however, must be accomplished manually and off-line.

SUMMARY OF THE INVENTION

It is an object of the present invention to provide a needle loom for needling a nonwoven web in which the phasing of the main shafts can be adjusted in a mechanically simple manner even during the operation of the needle loom.

According to an aspect of the invention, a needle loom for needling a nonwoven web comprises a needle beam arrangement with least one needle beam and further comprises a drive device for moving the needle beam arrangement back and forth in a punching direction. The drive device comprises a drive and a first main shaft and a second main shaft, wherein a first main conrod is eccentrically supported on the first main shaft and connects the first main shaft to the needle beam arrangement in articulated fashion, and wherein a second main conrod is eccentrically supported on the second main shaft and connects the second shaft to the needle beam arrangement in articulated fashion. The first and second main shafts are driven so that they rotate in opposite directions. The drive devices comprises an endless transmission element, which couples the first and second main shafts together. The transmission element also passes over a first and a second adjusting roller. An adjusting device is provided for the translational adjustment of the position of the first and second adjusting rollers. The translational adjustment of the position of the first and second adjusting rollers by the adjusting device brings about a rotational adjustment of the phasing of the first and second main shafts with respect to each other.

With this configuration, a needle loom for needling a nonwoven web is created by the phasing of the main shafts which can be adjusted in a mechanically simple manner.

A first disk-shaped engagement element with a substantially circular cross section is preferably connected nonrotatably to the first main shaft, and a second disk-shaped engagement element with a substantially circular cross section is connected nonrotatably to the second main shaft. These engagement elements cooperate with the transmission element. The first and second engagement elements are preferably configured as toothed-belt pulleys. In this way, force can be reliably transmitted between the transmission element and the engagement elements, and thus the two main shafts can be reliably coupled to each other. A double-sided toothed belt is especially well-adapted for use as the transmission element.

In a preferred embodiment, the circumference of the first and second engagement elements is larger than the circumference of the first and second adjusting rollers. Thus the phase angle of the two main shafts to each other can be adjusted with an especially high degree of accuracy.

A reliable coupling of the two main shafts, which are to be driven in opposite directions, is guaranteed when a first side of the transmission element engages with a circumferential region of the first engagement element, and the second side of the transmission element engages with a circumferential region of the second engagement element.

It is especially preferred that the transmission element be arranged substantially in the form of a sideways-oriented U-shape.

In this case, it is preferable for the first and second engagement elements to be arranged next to each other in the area of a base section of the U-shape of the transmission element in such a way that an outer loop of the transmission element wraps around the circumferential region of the first engagement element in the area of the base section of the U-shape, and an inner loop of the transmission element wraps around the circumferential region of the second engagement element in the area of base section of the U-shape.

It is also preferable for the first adjusting roller to be arranged on an end section of a first leg of the U-shape of the transmission element in such a way that a loop of the transmission element wraps around a circumferential region of the first adjusting roller, and for the second adjusting roller to be arranged on an end section of a second leg of the U-shape of the transmission element in such a way that a loop of the transmission element wraps around a circumferential region of the second adjusting roller.

As the transmission element travels around the first adjusting roller and around the second adjusting roller, the transmission element preferably undergoes a substantially 180° turn in each case.

The adjusting device preferably comprises a pivotable arm, on the opposite ends of which the first and second adjusting rollers are supported. Because of the symmetric structure, therefore, a length compensation of the transmission element upon the pivoting of the pivotable arm can be easily achieved.

In a preferred embodiment, the adjusting device comprises a spindle stroking device for the translational adjustment of the first adjusting roller. In this way, the translational adjustment of the first adjusting roller can be achieved with especially good accuracy.

In this case it is possible for the adjusting device to comprise a tensioning device for applying a pretension to the second adjusting roller. In this way, a length compensation of the transmission element upon the translational adjustment of the first adjusting roller can be easily achieved. Alternatively, the adjusting device can comprise an additional spindle stroking device for the translational adjustment of the second adjusting roller.

It is especially preferable for the adjusting device to be actuated by a motor. In this way, the control of the phase adjustment of the main shafts can be achieved automatically in a closed-loop manner.

DETAILED DESCRIPTION OF SPECIFIC EMBODIMENTS

The drawings show only the components of a needle loom which are essential to the description of the invention. For example, the machine housing, the stripper plate, and the punching plate, the arrangement of which is familiar to the skilled person, are not shown for the sake of clarity. The nonwoven web to be needled is not shown either.

Figure 1:
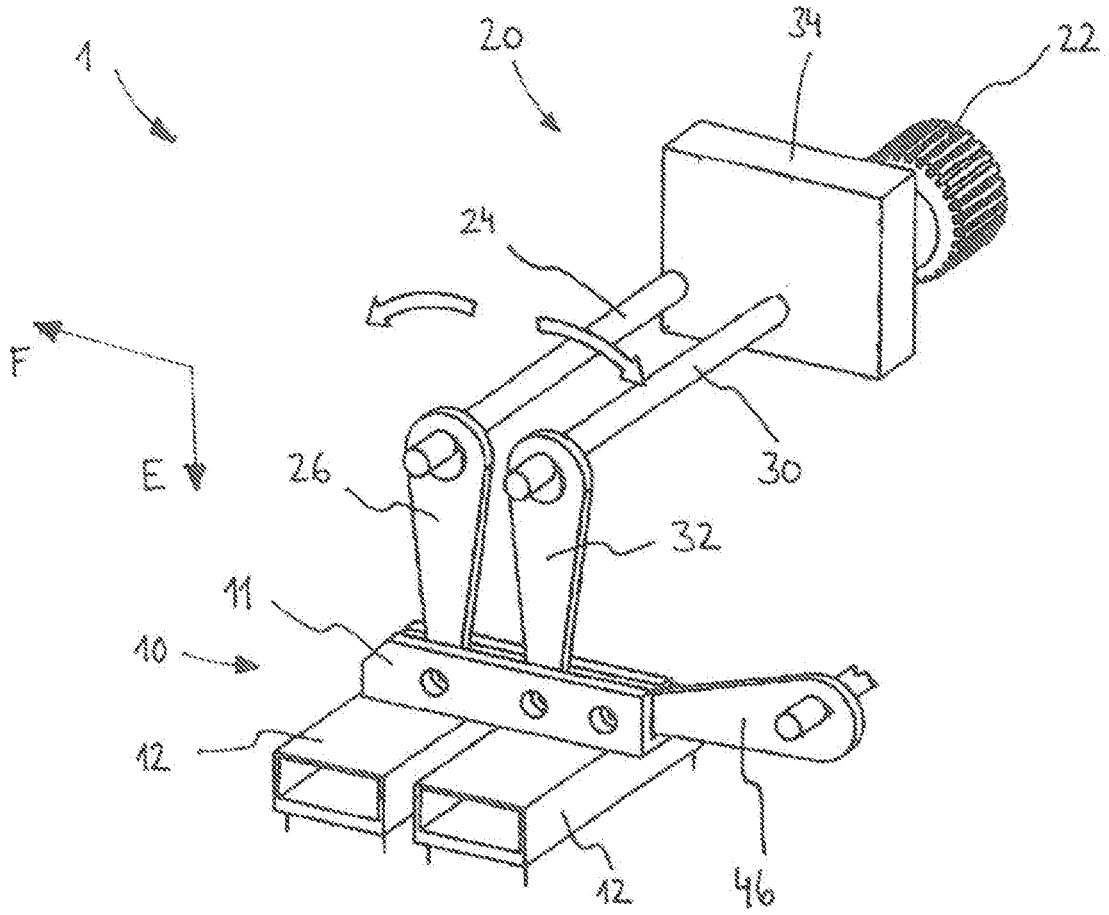
FIG. 1 is a schematic perspective view of an embodiment of a needle loom according to the invention.

FIG. 1 shows a schematic diagram, in perspective, of part of an embodiment of a needle loom 1 according to the invention. The needle loom 1 comprises a needle beam arrangement 10 and a drive device 20. The needle beam arrangement 10 comprises at least one needle beam 12. In the embodiment shown here, two needle beams 12 are provided, which are attached to a needle beam carrier 11 and are supported by it. It is obvious that, depending on the existing requirements, it is also possible to use only one needle beam 12 or as many additional ones as desired. By way of example, a needle board with only single needles at the edges is shown here, these needles projecting from the surface of each of the needle beams 12 facing away from the drive device 20. It is obvious that, in an actual realization of a needle loom 1 according to the invention, multiple rows of needles will be arranged on the bottom surface of each needle board.

In the exemplary embodiment described here, the punching direction of the needles into the nonwoven web, indicated in FIG. 1 by the arrow E, is oriented vertically. It is obvious that a deviation from a precisely vertical orientation is possible under certain conditions. A needle beam guide 46 is provided to guide the needle beam arrangement 10 in the punching direction E and possibly also to guide the needle beam arrangement 10 in the conveying direction F of the nonwoven web. Such guides are generally known and will not be described in greater detail here.

The drive device 20 moves the needle beam arrangement 10 back and forth in the punching direction E. This normally corresponds to a vertical stroking movement of the needle beam 12. The drive device 20 comprises a drive 22, a first main shaft 24, a first main conrod 26, a second main shaft 30, and a second main conrod 32. The first main conrod 26 and the second main conrod 32 are each connected to the needle beam arrangement 10 in articulated fashion and are preferably fastened to the needle beam carrier 11. The first main conrod 26, at the end facing away from the needle beam arrangement 10, is connected in articulated fashion to the first main shaft 24, whereas the second main conrod 32, at the end facing away from the needle beam arrangement 10, is connected to the second main shaft 30 in articulated fashion. The first and second main conrods 26, 32 are connected to the first and second main shafts 24, 30 in such a way that a rotational movement of the main shafts 24, 30 is converted into a substantially linear movement of the needle beam arrangement 10. Especially well adapted to use for this purpose is an eccentric connection of the main conrods 26, 32 to the main shafts 24, 30, wherein in each case a conrod eye is rotatably supported on an eccentric section of the shaft in question.

The main shafts 24, 30 are driven by the drive 22 so that they rotate in opposite directions, as indicated by the arrows. The required gear arrangement 34 for coupling the two main shafts 24, 30 is described in greater detail on the basis of the following drawings and is indicated only schematically in FIG. 1 for the sake of clarity. An electric motor, for example, is suitable as the drive 22. In addition to the direct connection shown between the drive 22 and the second main shaft 30, it is also possible to connect the drive 22 indirectly, i.e., by a belt transmission with a toothed belt, to the main shaft 30. Similarly, the first main shaft 24 can be the main shaft which is driven directly. This is the preferred situation, as shown in the exemplary embodiments according to FIGS. 2-6.

FIGS. 2-6 show only the components of the needle loom 1 which are relevant to the phase adjustment of the main shafts 24, 30.

Figure 2:
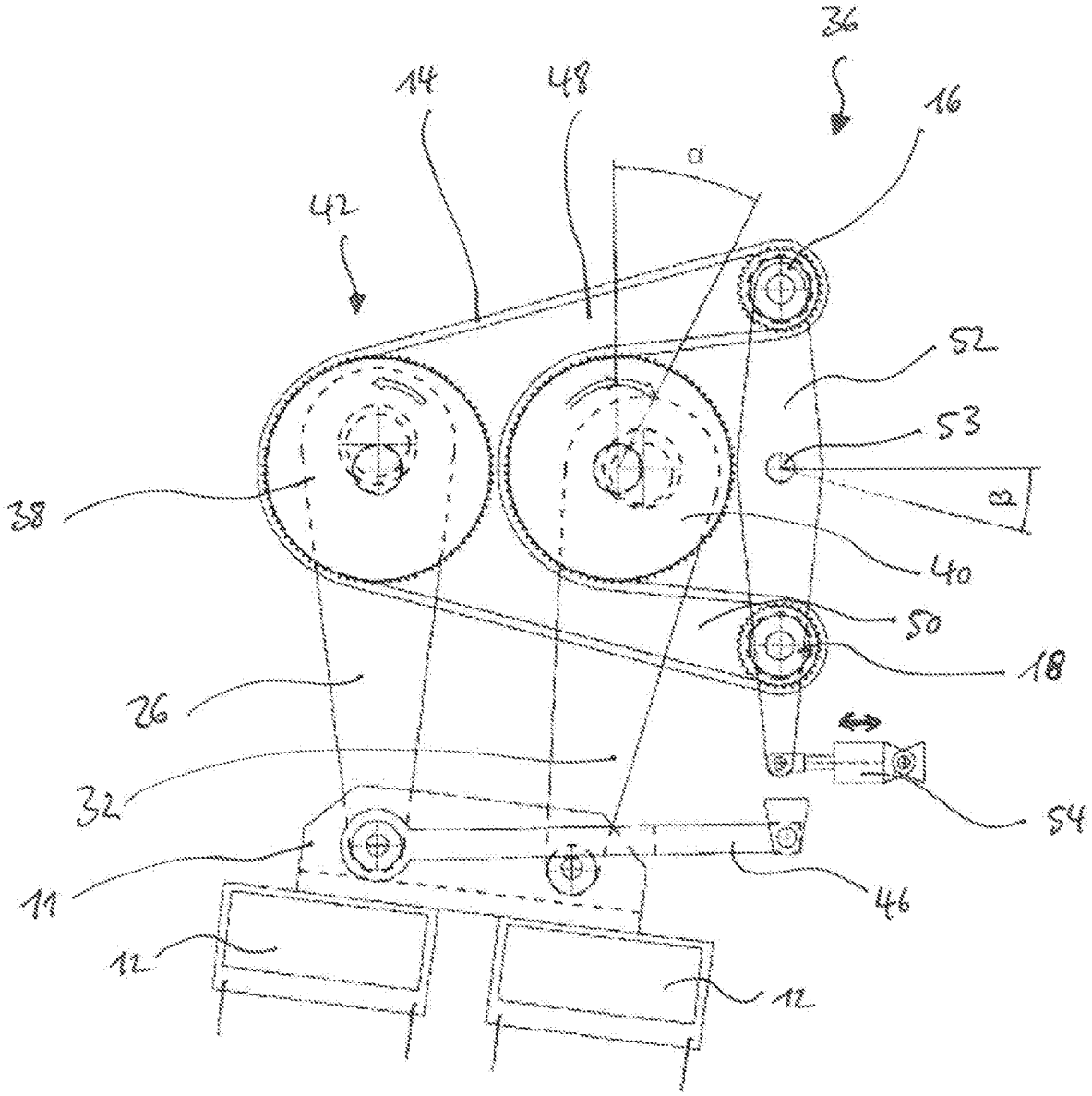
FIG. 2 is a schematic side view of essential components of an embodiment of a needle loom according to the invention.

As shown in FIG. 2, the drive device comprises an endless transmission element 14, which couples the first and second main shafts 24, 30 to each other. The transmission element 14 is preferably configured as a double-sided toothed belt. The width of the transmission element 14 is usually in the range of 80-120 mm. So that force can be transmitted between the transmission element 14 and the two main shafts 24, 30, engagement elements 38, 40 must be provided on the main shafts 24, 30, with which the transmission element 14 can engage. In the embodiment shown here, these engagement elements 38, 40 are configured as toothed-belt pulleys, which are connected nonrotatably to the associated main shafts 24, 30. Many other configurations could be considered, however, such as a chain as the transmission element 14 and sprockets as the engagement elements 38, 40.

The transmission element 14 is arranged substantially as a sideways-oriented U-shape. More concretely expressed, the first and second engagement elements 38, 40 are arranged next to each other in the area of a base section 42 of the U-shape of the transmission element 14 in such a way that an outer loop of the transmission element 14 wraps around a circumferential region of the first engagement element 38 in the area of the base section 42 of the U-shape, and an inner loop of the transmission element 14 wraps around a circumferential region of the second engagement element 40 in the area of the base section 42 of the U-shape.

The transmission element 14 also passes over two adjusting rollers 16, 18. The first of these adjusting rollers 16 is arranged at an end section of a first leg 48 of the U-shape of the transmission element, and the second adjusting roller 18 is arranged at an end section of a second leg 50 of the U-shape of the transmission element 14. One loop of the transmission element 14 thus wraps around a circumferential region of the first adjusting roller 16, and another loop of the transmission element 14 wraps around a circumferential region of the second adjusting roller 18. As transmission element 14 passes around the first adjusting roller 16 and around the second adjusting roller 18, it undergoes a 180° turn in each case.

In the present case, the two adjusting rollers 16, 18 are oriented vertically with respect to each other. The adjusting rollers 16, 18 in the embodiment shown here are, with respect to their horizontal orientation, located laterally next to the two engagement elements 38, 40, wherein the first adjusting roller 16 is also, with respect to its vertical orientation, above the engagement elements 38, 40, and the second adjusting roller 18 below the engagement elements 38, 40. It is preferable for the circumference of the engagement elements 38, 40 to be larger than the circumference of the first and second adjusting rollers 16, 18.

As a result of this arrangement, a first side of the transmission element 14 engages with a circumferential region of the first engagement element 38, and a second side engages with a circumferential region of the second engagement element 40. Because of this coupling of the two main shafts 24, 30 by way of the transmission element 14, only one of the two main shafts 24, 30 must be actively driven by the drive 22 during the operation of the needle loom 1, whereas the other one of the two main shafts 23, 40 is driven indirectly by way of the transmission element 14 in the opposite rotational direction.

An adjusting device 36 for the translational adjustment of the position of the first and second adjusting rollers 16, 18 is also provided. In the exemplary embodiment of FIG. 2, the adjusting device 36 comprises a pivotable arm 52, at the opposing end areas of which the first and second adjusting rollers 16, 18 are rotatably supported. The pivot axis 53 of the pivotable arm 52 is arranged at substantially the center of the pivotable arm 52. To achieve the desired pivoting of the pivotable arm 52, a spindle stroking device 54, which acts on an outer end section of the arm 52, is provided. By pivoting the arm 52, the spindle stroking device 54 leads to a translational adjustment of the first and second adjusting rollers 16, 18 in opposite directions.

As a result of the U-shaped arrangement of the transmission element 14, a translational adjustment of the adjusting rollers 16, 18 in opposite directions brings about, while the engagement element 38 is stationary (i.e., while the main shaft 24 is kept stationary), a rotation of the second engagement element 40 around a certain angle $\alpha$. This angle $\alpha$ is correlated with the pivot angle $\beta$ of the pivotable arm 52. When, in the example of FIG. 2, the spindle stroking device 54 travels toward the left, the second adjusting roller 18 therefore also shifts toward the left, whereas the first adjusting roller 16 shifts toward the right. Because of the engagement of the teeth of the transmission element 14 with the adjusting rollers 16, 18, the transmission element 14 moves in a clockwise direction in the area of the second engagement element 40 and thus turns the second engagement element 40 and the second main shaft 30 connected to it around the angle $\alpha$ onward in the clockwise direction. As a result, a phase difference between the two main shafts 24, 30 is produced. If there was already a phase shift between the main shafts 24, 30, this can be adapted in the manner just described.

It would also be possible to keep the second engagement element 40 stationary instead of the first engagement element. Then the translational adjustment of the adjusting rollers 16, 18 brings about a rotation of the first engagement element 38 around the angle in the counterclockwise direction. Finally, it is also conceivable that an adjustment of the relative phase angle $\alpha$ of the two main shafts 24, 30 to each other could be produced by allowing the two main shafts 24, 30 to rotate in opposite directions upon the adjustment of the adjusting rollers 16, 18.

By the arrangement described above, it is possible to adjust the phase angle even during ongoing operations. The angle $\alpha$ typically has a value in the range of 1-20°. In this way, a horizontal stroke of the needle beam arrangement 10 can be easily set to a value in the range of 1-15 mm by changing the phasing of the two main shafts 24, 30 to modify the tipping movement of the needle beam and the elliptical curve of its movement.

Figure 3:
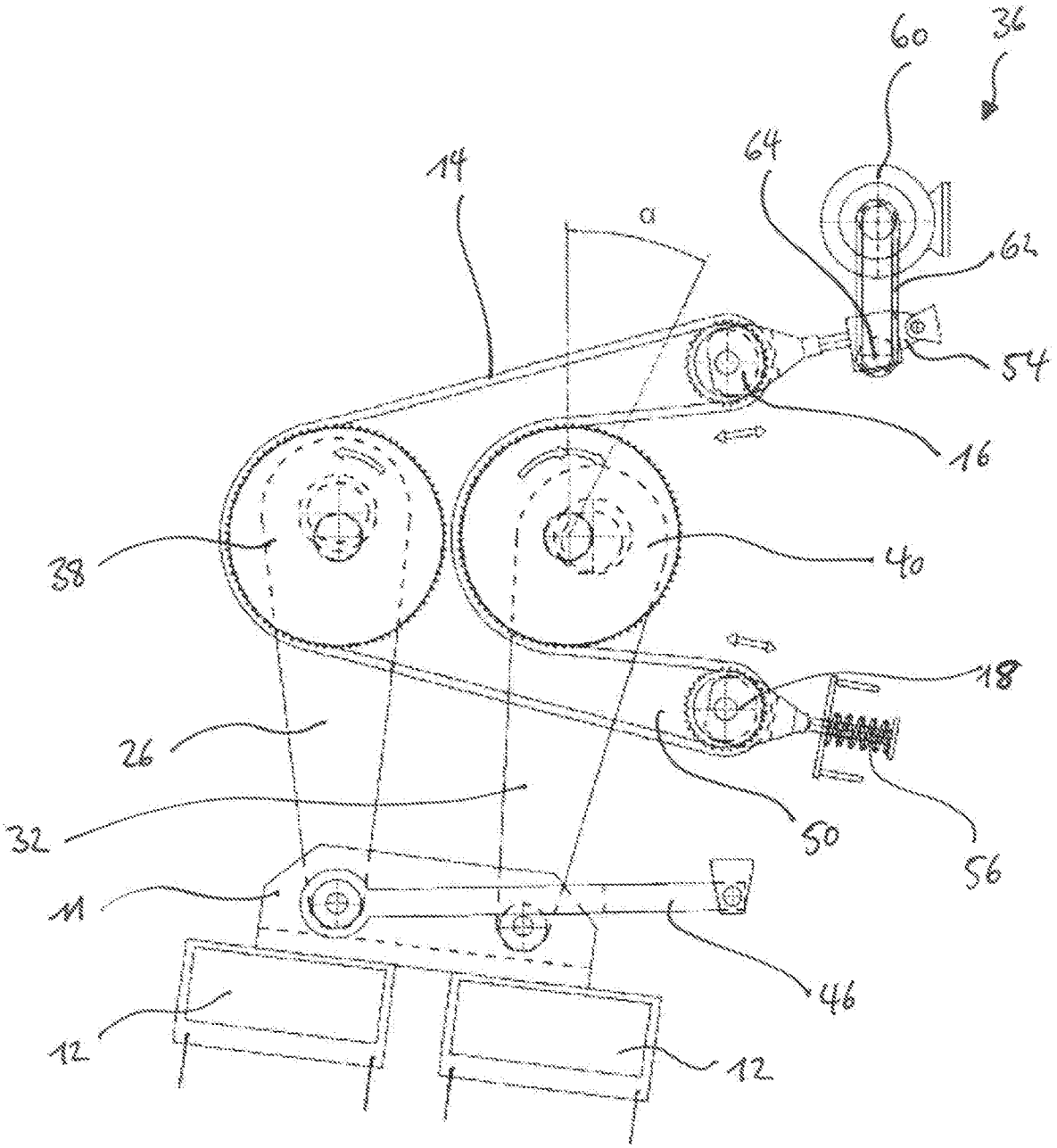
FIG. 3 is a schematic side view of essential components of another embodiment of a needle loom according to the invention.

The embodiment according to FIG. 3 corresponds to the embodiment of FIG. 2 with the difference that the translational adjustment of the first adjusting roller 16 and of the second roller 18 is achieved in a different manner. The adjusting device 36 comprises now a spindle stroking device 54, which can move the first adjusting roller 16 actively back and forth. The spindle stroking device 54 is driven by a motor 60, which can be a servo motor, for example. This is preferably done by element of a toothed belt 62 and belt pulleys 64, but obviously there are also other ways in which the force could be transmitted from the motor 60 to the spindle stroking device 54 such as by a chain and sprockets.

To ensure the length compensation function for the loops of the transmission element 14 without any change in the tension of the transmission element 14, the second adjusting roller 18 is supported on a tensioning device 56. The tensioning device 56 can contain, for example, a compression spring, which pushes the second adjusting roller 18 in a direction toward the second leg 50 of the U-shape of the transmission element 14. It would also be possible for the tensioning device 56 to contain a tension spring or some other type of tensioning element.

Figure 4:
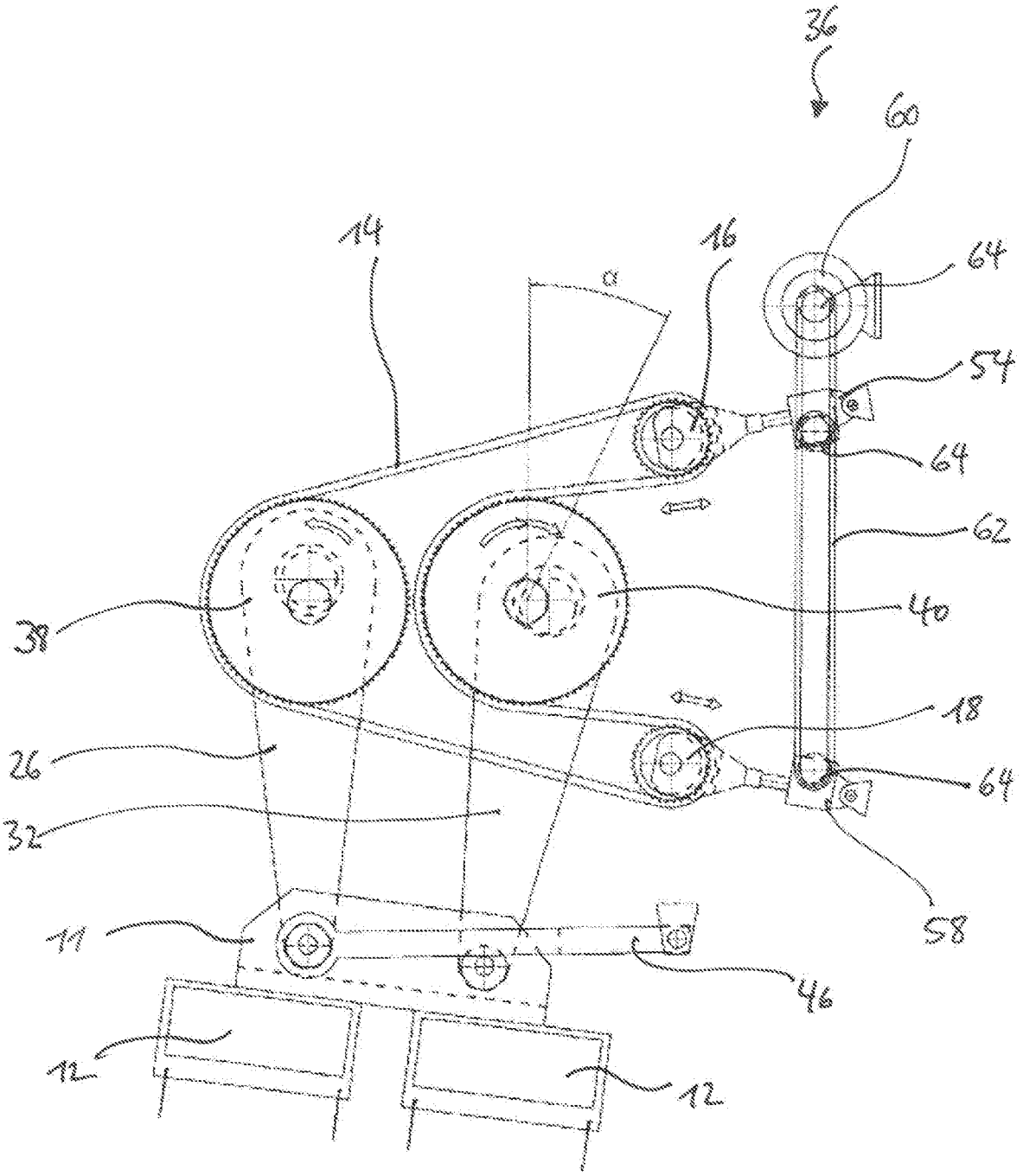
FIG. 4 is a schematic side view of essential components of another embodiment of a needle loom according to the invention.

In the embodiment according to FIG. 4, a similar configuration of the adjusting device 36 is shown, in which the position of the first adjusting roller 16 is shifted in a manner nearly identical to that used in the exemplary embodiment according to FIG. 3. Here, however, a second spindle stroking device 58 is provided to shift the position of the second adjusting roller 18. The two spindle stroking devices 54, 58 can be actuated by separate drives, but it is a logical option to use the same motor 60 to drive both spindle stroking devices 54, 58 to ensure in a simple manner that both adjusting rollers 16, 18 experience a translation distance of the same absolute value but in opposite directions. Again, a toothed belt 62 and belt pulleys 64 can be used to transfer force between the motor 60 and the spindle stroking devices 54, 58. It would also be possible to use chains and sprockets or similar, known force-transmitting mechanisms.

A simultaneous clockwise movement of the two belt pulleys 64, which are connected to the first and second spindle stroking devices 54, 58, brings about, for example, a retraction of the first spindle stroking device 54 and thus a movement of the first adjusting roller 16 toward the right. Simultaneously, the spindle stroking device 58 is extended, and the second adjusting roller 18 is moved to the left by the same amount.

Figure 5:
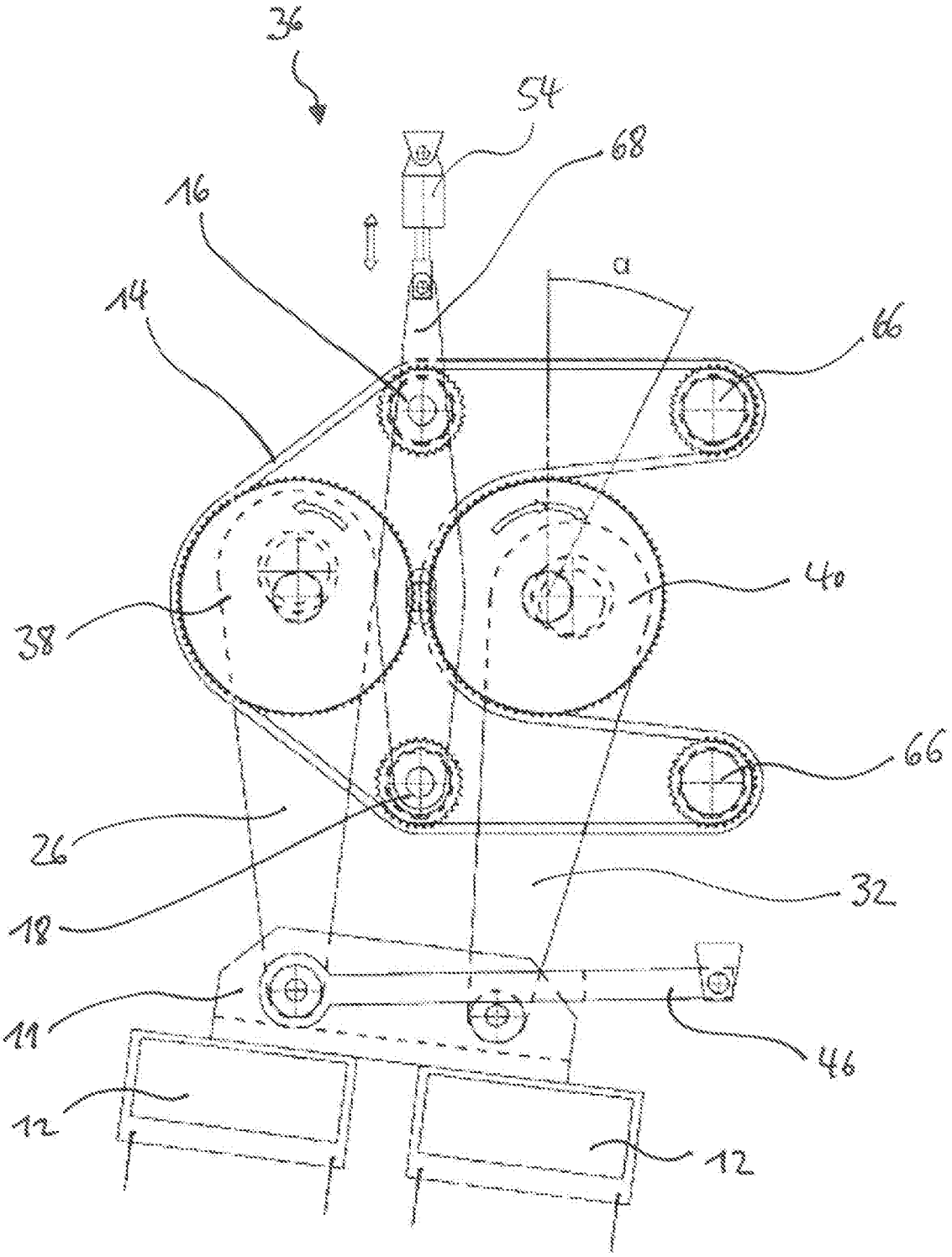
FIG. 5 is a schematic side view of essential components of another embodiment of a needle loom according to the invention.

The embodiment shown in FIG. 5 corresponds substantially to the embodiment according to FIG. 2, wherein two passive deflecting pulleys 66 instead of the two adjusting rollers 16, 18 are arranged in the area of the end sections of the two legs 48, 50 of the U-shape of the transmission element 14. The adjusting rollers 16, 18, in contrast, are, with respect to their horizontal orientation, arranged in the area between the two engagement elements 38, 40 and are oriented vertically with respect to each other. One of the adjusting rollers 16 is arranged above the engagement elements 38, 40, the other one below.

The two adjusting rollers 16, 18 are preferably supported on a carrier 68, which can be moved back and forth in the up and down directions by a spindle stroking device 54. As a result of this vertical displacement, a phase adjustment of the two main shafts 24, 30 with respect to each other by the angle $\alpha$ is again achieved.

It would also be conceivable that the two adjusting rollers 16, 18 could be arranged in the position shown in FIG. 5, but on a pivotable arm like the arm of FIG. 2. A pivoting movement of this arm would then achieve a similar effect.

Figure 6:
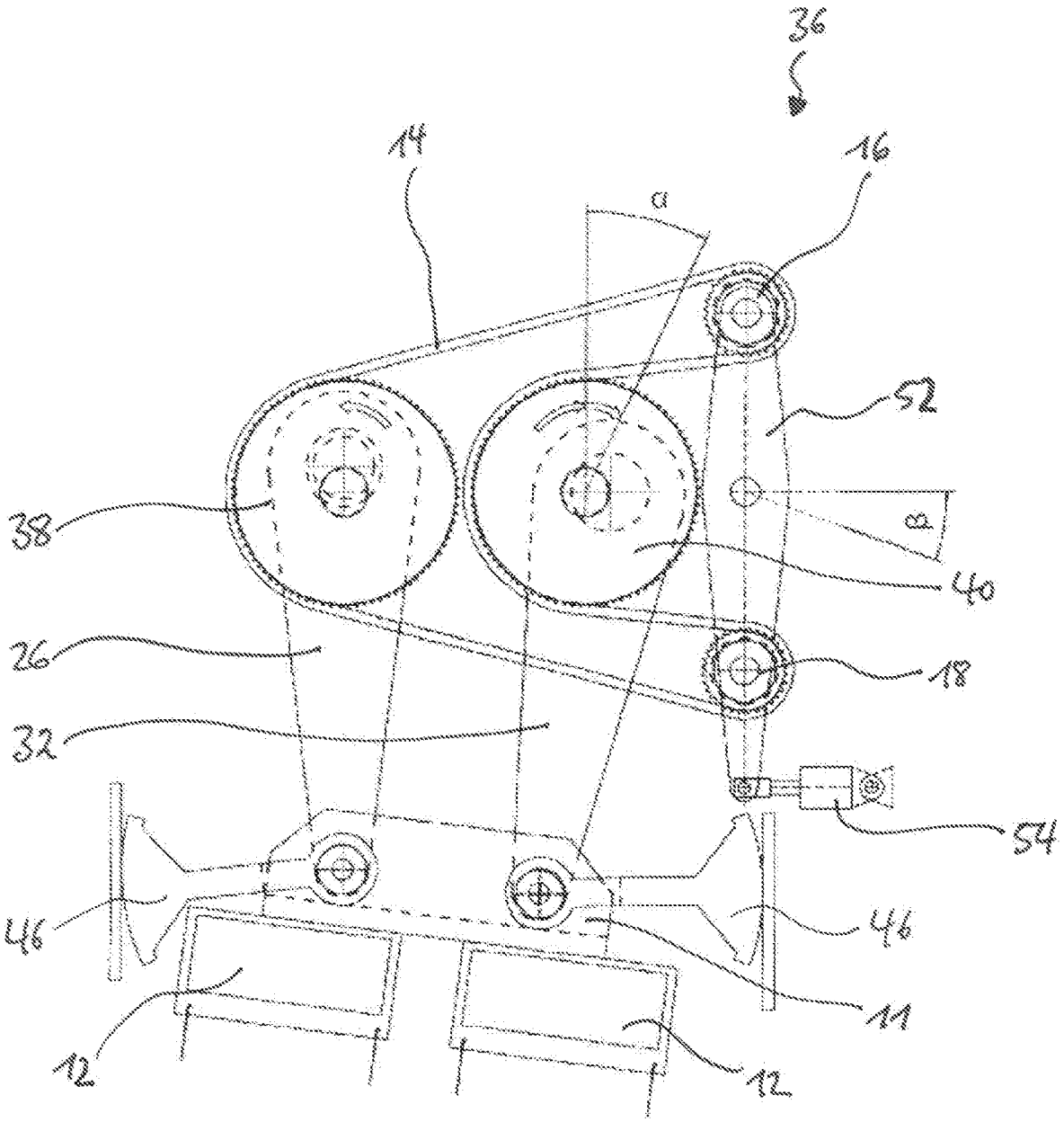
FIG. 6 is a schematic side view of essential components of another embodiment of a needle loom according to the invention.

The embodiment of FIG. 6 corresponds to the embodiment of FIG. 2, the only difference being that the needle beam guide 46 is configured here as a cam lever guide. A cam lever guide could also be used as the needle beam guide 46 in the embodiments shown in FIGS. 3-5.

In addition to the relative geometric arrangements of the engagement elements 38, 40 and of the adjusting rollers 16, 18 shown here, the skilled person will perceive that there are also many other arrangements which are possible within the scope of the invention. The important point in each case is that, because of the geometric arrangement of the elements with respect to each other, a translational adjustment of the position of the two adjusting rollers 16, 18 will automatically result in a rotational adjustment of one of the two engagement elements 38, 40 and thus of one of the two main shafts 24, 30 with respect to the other.

Each of the spindle stroking devices 54, 58 can be actuated by a motor. Each of the spindle stroking devices 54, 58 can also be monitored by sensors.

A display unit, which shows the extent of the horizontal stroke in millimeters, is preferably available at the control panel of the needle loom. The operator can preferably set the horizontal stroke by way of an input device, and a controller will control the motor 60 of the adjusting device 36 on the basis of the input value. For this purpose, the controller can make use of data stored in a library, for example.

It is especially preferable for the adjusting process to be conducted under closed-loop control. The actual values which are required for this closed-loop control and which are compared with stored nominal values can be acquired by the sensor technology of the adjusting device itself, or preferably by a sensor which detects the extent of the horizontal stroke.

Overall, the present invention makes it possible to achieve a relatively simple electromechanical adjustment of the phase angle of the two main shafts of a needle loom with respect to each other.

A wide variety of materials are available for the various parts discussed and illustrated herein. While the principles of this device have been described in connection with specific embodiments, it should be understood clearly that these descriptions are made only by way of example and are not intended to limit the scope of the device.

The invention claimed is:

1. A needle loom for needling a nonwoven web, comprising:

a needle beam arrangement which includes at least one needle beam; and a drive device for moving the needle beam arrangement back and forth in a punching direction, the drive device including:

a drive, first and second main shafts which are driven rotationally in opposite directions, first and second main conrods which (a) connect the first and second main shafts, respectively, to the needle beam arrangement in articulated fashion and (b) are eccentrically supported each on its respective main shaft, an endless traveling transmission element which couples the first and second main shafts to each other, the transmission element also passing around a first adjusting roller and a second adjusting roller; and an adjusting device for translational adjustment of the position of the first and second adjusting rollers brings about a rotational adjustment of a phasing of the first and second main shafts with respect to each other.

2. The needle loom of claim 1 wherein a first disk-shaped engagement element with a circular cross section is connected nonrotatably to the first main shaft, and wherein a second disk-shaped engagement element with a circular cross section is connected nonrotatably to the second main shaft, wherein the first and the second engagement elements cooperate with the transmission element.

3. The needle loom of claim 2 wherein the first and second engagement elements are configured as toothed-belt pulleys and the transmission element is configured as a double-sided toothed belt.

4. The needle loom of claim 2 wherein a circumference of each of the first and second engagement elements is larger than a circumference of each of the first and second adjusting rollers.

5. The needle loom of claim 1 wherein a first side of the transmission element engages with a circumferential region of the first engagement element, and wherein a second side of the transmission element engages with a circumferential region of the second engagement element.

6. The needle loom of claim 5 wherein the transmission element is arranged in the form of a sideways-oriented U-shape, the first and second engagement elements are arranged next to each other in an area of a base section of the U-shape of the transmission element in such a way that an outer loop of the transmission element wraps around the circumferential region of the first engagement element in the area of the base section of the U-shape, and an inner loop of the transmission element wraps around a circumferential region of the second engagement element in the area of the base section of the U-shape.

7. The needle loom of claim 6 wherein the first adjusting roller is arranged on a first leg end section of a first leg of the U-shape of the transmission element in such a way that a first loop of the transmission element wraps around a circumferential region of the first adjusting roller, and wherein the second adjusting roller is arranged on a second leg end section of a second leg of the U-shape of the transmission element in such a way that a second loop of the transmission element wraps around a circumferential region of the second adjusting roller.

8. The needle loom of claim 1 wherein, as the transmission element passes around the first adjusting roller and around the second adjusting roller, the transmission element undergoes a 180° turn in each case.

9. The needle loom of claim 1 wherein the adjusting device comprises a pivotable arm, wherein on opposite end areas of the arm the first and second adjusting rollers are supported.

10. The needle loom of claim 1 wherein the adjusting device comprises a spindle stroking device for a translational adjustment of the first adjusting roller.

11. The needle loom of claim 10 wherein the adjusting device comprises a tensioning device for applying a pretension to the second adjusting roller or a second spindle stroking device for a translational adjustment of the second adjusting roller.

12. The needle loom of claim 1 wherein the adjusting device is actuated by a motor.

13. The needle loom of claim 12 wherein the motor is controlled by a controller, which receives data from an input device configured to be operated by an operator.

14. The needle loom of claim 12 wherein adjusting the horizontal stroke occurs under closed-loop control.

* * * * *